US012637262B1

(12) United States Patent
Grigoryan et al.

(10) Patent No.: US 12,637,262 B1
(45) Date of Patent: May 26, 2026

(54) TUMBLER

(71) Applicant: Vahe Grigoryan, La Crescenta, CA (US)

(72) Inventors: Vahe Grigoryan, La Crescenta, CA (US); Vardan Grigoryan, La Crescenta, CA (US)

( * ) Notice: Subject to any disclaimer, the term of this patent is extended or adjusted under 35 U.S.C. 154(b) by 0 days.

(21) Appl. No.: 19/444,183

(22) Filed: Jan. 9, 2026

(51) Int. Cl.
*B65D 47/06* (2006.01)
*B65D 43/02* (2006.01)

(52) U.S. Cl.
CPC ..... *B65D 47/06* (2013.01); *B65D 43/0214* (2013.01); *B65D 43/0225* (2013.01); *B65D 2251/0018* (2013.01); *B65D 2251/0081* (2013.01); *B65D 2543/00046* (2013.01)

(58) Field of Classification Search
CPC ..... B65D 47/06; B65D 43/0214; B65D 43/0225; B65D 2251/0018; B65D 2251/0081; B65D 2543/00046; B65D 2231/022; B65D 2543/00509; B65D 21/0228; B65D 2313/04; B65D 25/48; B65D 2547/063; A47G 21/18; A47G 19/2266; A47G 19/2222; A47G 21/185; A47G 2200/10; Y10T 137/0402
USPC ..... 220/705, 835; 215/388, 6; 206/217
See application file for complete search history.

(56) References Cited

U.S. PATENT DOCUMENTS 4,699,318 A * 10/1987 Donatello ..... A47G 21/182 215/388
2022/0009697 A1* 1/2022 Olmstead ..... B65D 47/06

FOREIGN PATENT DOCUMENTS

CN 215499090 U * 1/2022

* cited by examiner

*Primary Examiner* — Don M Anderson
*Assistant Examiner* — John Martin Hoppmann
(74) *Attorney, Agent, or Firm* — Phil IP Law Inc.; Karen Kirk Galoyan; Narek Zohrabyan

(57) ABSTRACT

A tumbler is disclosed comprising a container, an inner cap having multiple mouthpiece sockets, a flexible conduit, and at least two mouthpieces. A tube may extend into the container to draw liquid and may connect through the flexible conduit to a mouthpiece positioned for use by a user. A magnetic mouthpiece holder may retain a mouthpiece when the mouthpiece is in use or not in use. A mouthpiece receptacle may be selectively connected to or disconnected from a ring worn on a user's finger, such that the mouthpiece may be held on the user's finger during use, between uses, or when not actively drinking. The tumbler may further support a closed-loop sanitizing method for cleaning the flexible conduit and mouthpieces without disassembly.

15 Claims, 6 Drawing Sheets

TUMBLER

BACKGROUND

The invention relates to beverage containers, and more particularly to tumblers configured to allow drinking with minimal attention disturbance, to a drinking system designed to enable safe hydration while operating a vehicle or engaging in activities requiring sustained attention.

Maintaining proper hydration during daily commutes and travel is essential for physical health, cognitive function, and overall wellbeing. However, conventional beverage containers require drivers to divert their visual attention from the road and remove at least one hand from the steering wheel to drink. Studies have shown that drivers lose approximately 22% of their attention span during the act of drinking water while driving. This momentary distraction creates significant safety risks, particularly during highway travel or in heavy traffic conditions.

The importance of hydration during commutes cannot be overstated. Dehydration, even in mild forms, can impair cognitive performance, reaction time, and decision-making abilities, all critical functions for safe driving. Yet, the very act of addressing this physiological need paradoxically compromises driver safety due to the attention demands of traditional drinking methods.

Current solutions for vehicle hydration include standard tumblers, water bottles, and insulated containers. However, these conventional containers share common limitations: they require visual attention to locate and grasp, often require tilting the head backward (compromising road visibility), lack convenient hands-free access mechanisms, and provide no sanitary storage solution for the mouthpiece between uses.

SUMMARY

In accordance with an aspect, there is provided a tumbler that may comprise a container, which may have an opening at an upper part thereof, an inner cap that may be configured to fit within the opening, wherein the inner cap may have at least two mouthpiece sockets. The tumbler may further comprise a cap, a flexible conduit which may have a first end and a second end, at least two mouthpieces comprising a first mouthpiece and a second mouthpiece, at least two tubes comprising a first tube and a second tube, and a magnetic mouthpiece holder which may comprise a mouthpiece receptacle and a ring. The first tube may extend through a first mouthpiece socket and may connect to the first mouthpiece through a first guiding opening. The flexible conduit at the first end may connect to an end opposite to the guiding opening of the first mouthpiece. Threads located on the end opposite to the guiding opening of the first mouthpiece may engage with female threads located in the first end of the flexible conduit. The flexible conduit at the second end may connect to an end opposite to the guiding opening of the second mouthpiece. The second end of the flexible conduit may be a friction-fit coupling. The second tube at one end may connect to the second mouthpiece through a second guiding opening. A ring tip may connect to an end of the second tube opposite to the end which connects to the second mouthpiece. The second tube may be configured to be inserted into the second mouthpiece socket. At least one of the mouthpieces may have a spherical knob attached thereto. The container may have container threads located on an outer part of the opening, and the cap may have inner cap threads configured to engage with the container threads. The inner cap may have a lip configured to sit on the opening of the container, and the cap may have a rubber seal positioned at the inner part thereof. The cap, at its upper part, may include a lid. The ring may further comprise a male magnet, and the mouthpiece receptacle may be constructed of ferromagnetic metal configured to magnetically couple with the male magnet, or alternatively, the mouthpiece receptacle may include a female metal element configured to magnetically engage with the male magnet.

In accordance with another aspect, a method of sanitizing components of a tumbler may be provided. The method may comprise connecting a first end of a flexible conduit to an end opposite to a guiding opening of a first mouthpiece, connecting a second end of the flexible conduit to an end opposite to a guiding opening of a second mouthpiece, and connecting one end of a second tube to the guiding opening of the second mouthpiece. A sanitizing solution may be introduced into another end of the second tube, and the other end of the second tube may be connected to the guiding opening of the first mouthpiece to form a closed loop comprising the second tube, the second mouthpiece, the flexible conduit, and the first mouthpiece. The closed loop may be agitated to distribute the sanitizing solution throughout internal surfaces of the closed loop. The sanitizing solution may be allowed to remain within the closed loop for a predetermined contact time sufficient for sanitization. The second tube may then be disconnected from the first mouthpiece, and the components of the closed loop may be flushed with clean water through the disconnected opening. The agitating may comprise shaking or manipulating the closed loop for a duration between 30 seconds and 2 minutes, and the predetermined contact time may be between 5 and 15 minutes. Alternatively, a first tube may be substituted for the second tube to form the closed loop.

DESCRIPTION OF THE DRAWINGS

Embodiments in accordance with the present disclosures are shown in the drawings and will be described below with reference to the figures, whereby elements having the same effect have been provided with the same reference numerals. The following is shown.

Figure 1:
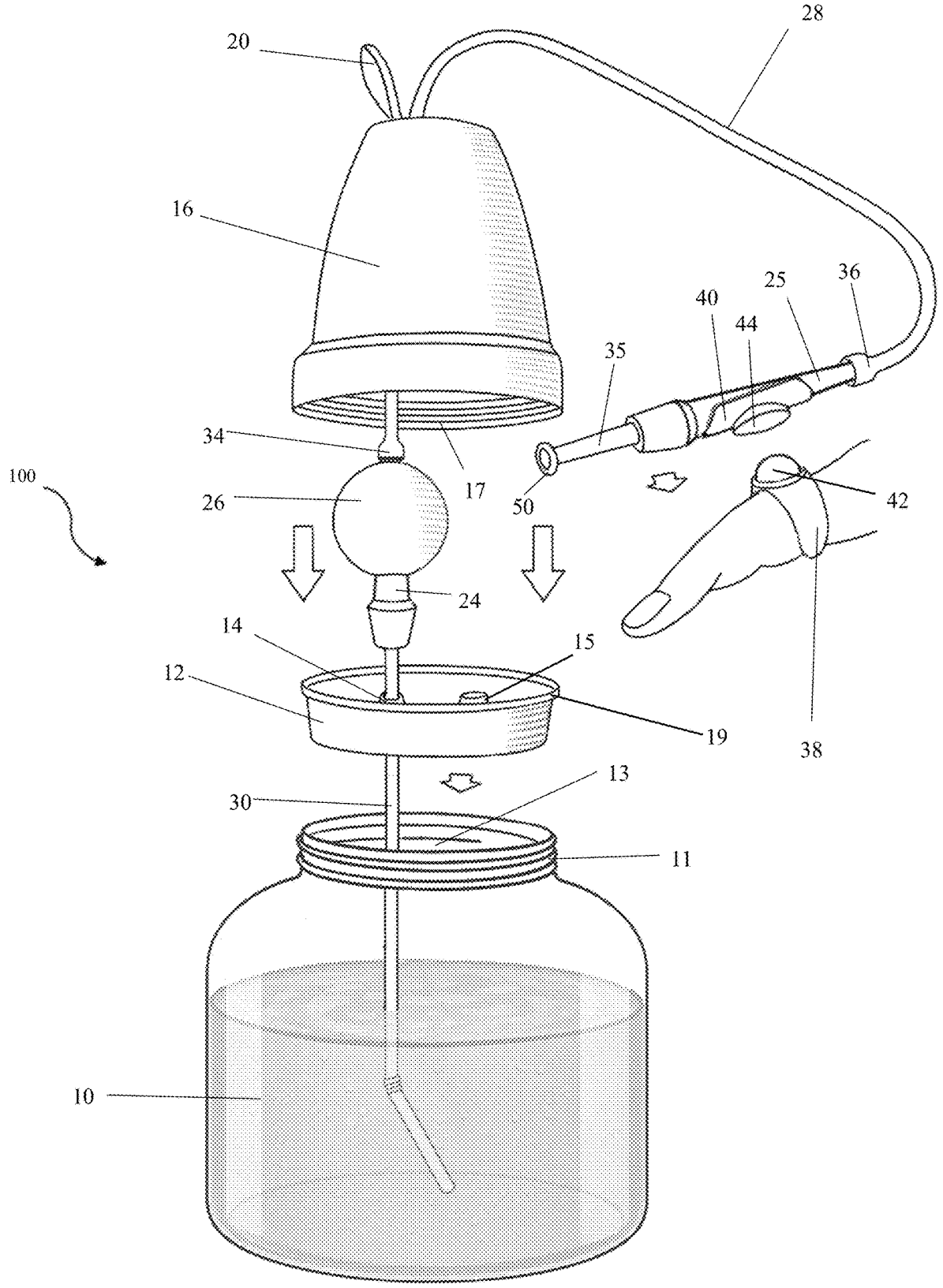
FIG. 1 shows a frontal exploded view of an embodiment of a tumbler.

To facilitate a comprehensive understanding of the tumbler, the following list is not limited but enumerates the reference numerals used throughout the description and drawings.

The list is as follows:

1. Tumbler 100
2. container 10
3. container threads 11
4. inner cap 12
5. opening 13
6. first mouthpiece socket 14
7. second mouthpiece socket 15
8. cap 16
9. cap threads 17
10. cap opening 18
11. lip 19
12. lid 20
13. rubber 22
14. first mouthpiece 24
15. second mouthpiece 25
16. spherical knob 26
17. threads 27
18. flexible conduit 28
19. female threads 29
20. first tube 30
21. first guiding opening 31
22. car container 32
23. second guiding opening 33
24. threaded coupling 34
25. second tube 35
26. friction-fit coupling 36
27. magnetic mouthpiece holder 37
28. ring 38
29. mouthpiece receptacle 40
30. male magnet 42
31. female metal element 44
32. sanitizer 48
33. ring tip 50

DESCRIPTION

Exemplified embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

FIG. 1 exemplifies an exploded view of an embodiment of the tumbler 100. The tumbler 100 incorporates a container 10 having container threads 11, an inner cap 12 having a first mouthpiece socket 14 and second mouthpiece socket 15, an outer cap 16 having cap threads 17 and a lid 20. It is also shown a first mouthpiece 24, connected to the one end of a flexible conduit 28 and on the other end to the first tube 30. A spherical knob 26 is attached to the first mouthpiece 24. The second mouthpiece 25 is connected at one end to the other end of the flexible conduit 28, and the second tube 35 is attached at one end to the opposite end of the second mouthpiece 25, with a ring tip 50 attached to the opposite end of the second tube 35. A mouthpiece receptacle 40 having a female metal element 44 is seated on the second mouthpiece 25, which is able to be attached to the male magnet 42 of the ring 38. The cap threads 17 engage with the container threads 11, securing the inner cap 12 in place. The rubber seal 22 provides a watertight connection, creating a complete seal.

The inner cap 12 fits within the opening 13 of container 10 and provides a sealed interface between the container 10 and the external components. The inner cap 12 includes the first mouthpiece socket 14, which receives and secures the first tube 30, and the second mouthpiece socket 15, which receives and secures the second tube 35. The first and second mouthpiece sockets 14 and 15 are configured to selectively accommodate either the first tube 30 or the second tube 35, thereby providing secure, leak-proof connection points. The flexible conduit 28 extends on one end from first mouthpiece 24 to first tube 30 through socket 14, providing a fluid pathway from the container 10 to the user. The flexible conduit 28 is preferably constructed of food-grade silicone, thermoplastic elastomer (TPE), or other flexible, non-toxic materials approved for food contact and resistant to both hot and cold beverages. The flexible conduit 28 has sufficient length, typically 18 to 36 inches, to allow positioning of the second mouthpiece 25 at various locations convenient to the user, such as near the steering wheel, attached to the user's finger. The flexible conduit 28 maintains flexibility across a wide temperature range to accommodate both hot beverages and cold drinks without becoming stiff or brittle.

The first tube 30 within the container 10 extends from first mouthpiece socket 14 toward the bottom of the container 10, ensuring fluid can be drawn even when the container 10 is nearly empty. This first tube 30 may be rigid or semi-rigid and is typically constructed of the same food-grade materials as the flexible conduit 28. The first tube 30 may alternatively be a disposable single-use straw. The first tube 30 ensures that liquid remains accessible throughout the drinking process, from when the container is full to when only a small amount of beverage remains.

The first mouthpiece 24 and the second mouthpiece 25 may be used in a fluid transfer configuration in which one mouthpiece functions as an inlet and the other functions as an outlet for user consumption of liquid. In one example, the first mouthpiece 24 may serve as an inlet in fluid communication with the container, while the second mouthpiece 25 may serve as an outlet from which a user consumes the liquid. However, the first mouthpiece 24 and the second mouthpiece 25 are interchangeable, and either mouthpiece may function as the inlet or the outlet depending on configuration. The first mouthpiece 24 and the second mouthpiece 25 are ergonomically designed for comfortable oral engagement and may be used in two ways: either for direct contact with the user's mouth when drinking directly from the mouthpiece, or with the second tube 35 attached.

The second tube 35 may be attached to either the first mouthpiece 24 or the second mouthpiece 25, and may further incorporate a ring tip 50. The ring tip 50 may be configured to be gently squeezed between the user's teeth, thereby allowing the user to hold, for example, the second mouthpiece 25 without using their hands while drinking liquid. Accordingly, both the first and second mouthpieces 24, 25 are interchangeable for drinking, provided that the first tube 30 is positioned within the container 10 and secured in either the first mouthpiece socket 14 or the second mouthpiece socket 15.

The second tube 35 may also incorporate a bite valve, push-pull valve, or twist-open valve mechanism to control fluid flow.

The magnetic mouthpiece holder 37 includes the mouthpiece receptacle 40 that cradles the second mouthpiece 25. The ring 38 may be worn on the user's finger.

In operation, the user fills the container 10 with the desired beverage by removing the outer cap 16 and inner cap 12, pouring the liquid, and reassembling the components.

The user may secure the first mouthpiece 24 in the first mouthpiece socket 14 and attach the mouthpiece receptacle 40 to the second mouthpiece 25, while wearing the ring 38 on a finger. The mouthpiece receptacle 40 may be magnetically coupled to the ring 38 by engagement of the male magnet 42 with the female metal element 44, thereby allowing the second mouthpiece 25 to be supported on the user's hand. When hydration is desired, the user may bring the second mouthpiece 25 toward the mouth and drink liquid either through the second tube 35 or directly through the second mouthpiece 25, without needing to look at or grasp the container 10. This design allows the user to drink while maintaining visual attention on the road ahead.

Figure 2:
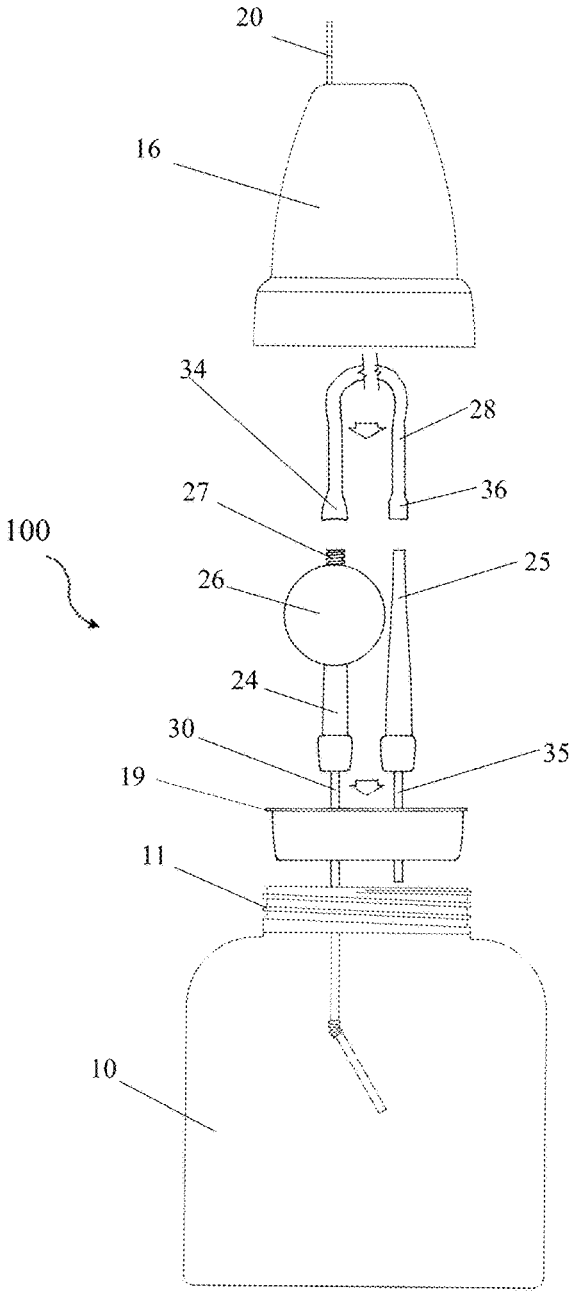
FIG. 2 shows a frontal exploded view of a tumbler.

FIG. 2 exemplifies a frontal exploded view of the tumbler 100, showing the container 10 having container threads 11, the outer cap 16, the lid 20, the flexible conduit 28, the first and second tubes 30 and 35, and the first mouthpiece 24 and second mouthpiece 25. In the present disclosure, the flexible conduit 28 has two ends, comprising a first end and a second end. The first end is defined as a threaded coupling 34, and the second end is defined as a friction-fit coupling 36. The assembly relationship demonstrates how the inner cap 12 fits within the opening 13, how the outer cap 16 secures the assembly via engagement of cap threads 17 (shown in FIGS. 1 and 3) with container threads 11, and how the flexible conduit 28 may pass through the cap opening 18 (shown in FIG. 3). The inner cap 12 includes a lip 19 at its upper peripheral edge thereof, the lip 19 is configured to seat on the opening 13 of the container 10. The lip 19 extends radially outward from the body of the inner cap 12 and rests on the rim of the opening 13, properly positioning the inner cap 12 within the container 10 and preventing it from falling through the opening 13.

Figure 3:
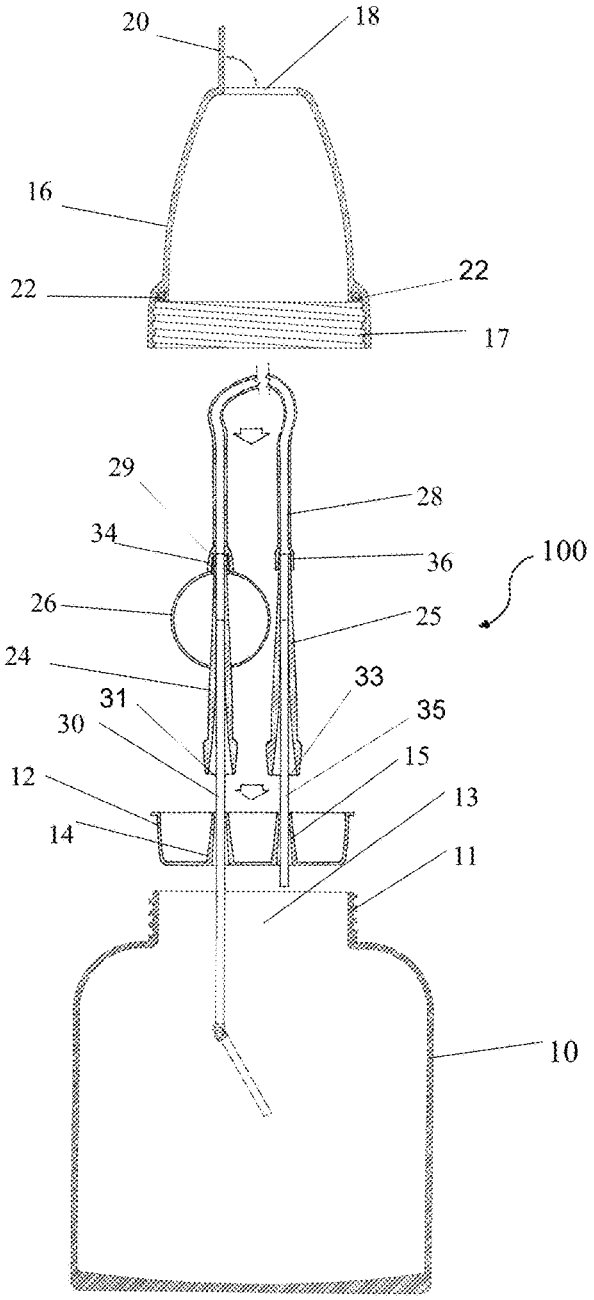
FIG. 3 shows a cross-sectional, exploded view of a tumbler along the line I-I of FIG. 7.
Figure 7:
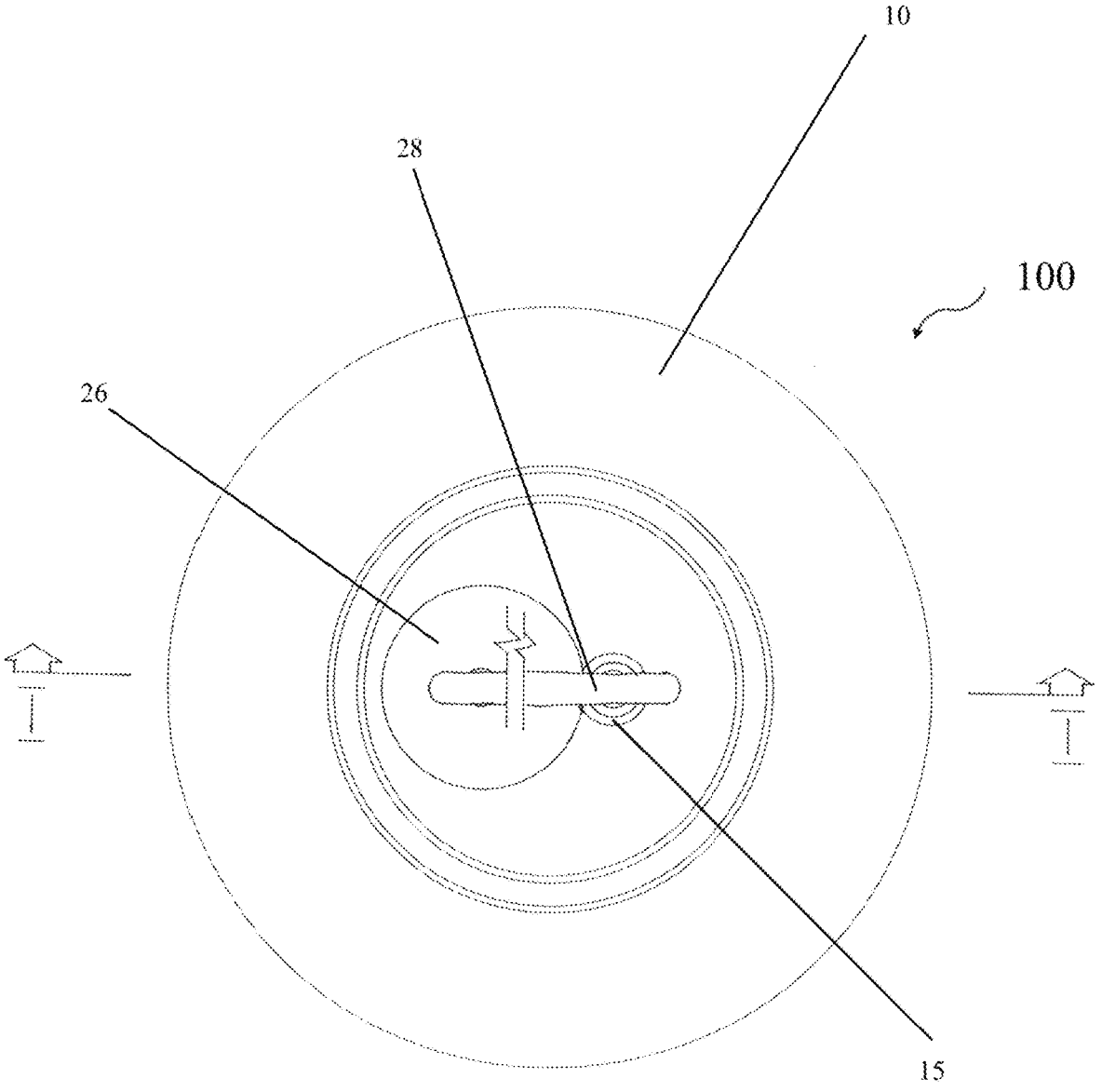
FIG. 7 shows a top down view of a tumbler.

FIG. 3 exemplifies a cross-sectional view of the assembled tumbler 100 taken along line I-I of FIG. 7, clearly showing the internal arrangement of components and the fluid pathway. The first tube 30 extends from the inner cap 12 through the first mouthpiece socket 14 toward the bottom of the container 10, ensuring fluid can be drawn from the container. The flexible conduit 28 through the threaded coupling 34 connects to the first mouthpiece 24, wherein in this embodiment, the first mouthpiece 24 has the male threads 27 on one end and the threaded coupling 34 has inner female threads 29. The threads 27 on the first mouthpiece 24 engage with corresponding female threads 29 in the threaded coupling 34, creating a secure, removable connection that can be disassembled for thorough cleaning or component replacement.

The first tube 30 is inserted at one end into the first mouthpiece 24 through the first guiding opening 31 and is tightly seated therein, providing the watertight connection. The other end of the flexible conduit 28 connects to the second mouthpiece 25 through a friction-fit coupling 36, while the second tube 35 is tightly seated within the second guiding opening 33, creating a continuous fluid pathway. The second tube 35 may be inserted into the second mouthpiece socket 15 in case if user does not use it. The rubber seal 22 provides a watertight connection between the inner cap 12 and the container 10 when the cap 16 is tightened onto the container 10.

The threaded coupling 34 provides a secure, sealed connection that resists accidental disconnection during active use or transport. The friction-fit coupling 36 allows quick attachment and detachment of the mouthpiece for cleaning or replacement, requiring only a firm push to connect and a pull to disconnect. The selection between the threaded coupling 34 and friction-fit coupling 36 depends on the specific application and user preference. The lid 20 serves multiple functions. When one of the mouthpieces, such as the first mouthpiece 24, is fixed to the first mouthpiece socket 14 and remains within the inner cap 12, the lid 20 allows the flexible conduit 28 to pass through the cap opening 18, while the second mouthpiece 25 extends outside the cap 16 for use by the user. In this configuration, the user drinks through the second tube 35 while the first mouthpiece 24 remains secured to the first mouthpiece socket 14 inside the cap 16. When the flexible conduit 28 and both mouthpieces 24, 25 are stored inside the cap 16, the lid 20 hermetically closes the cap opening 18, thereby preventing contamination and providing protection of the stored components when the system is not in use.

In various embodiments, the flexible conduit 28 may be configured with different coupling arrangements at its two ends to accommodate various user preferences and applications. The flexible conduit 28 may incorporate two threaded couplings 34 at both ends for maximum security and leak prevention, two friction-fit couplings 36 at both ends for quick connection and disconnection, or a combination thereof. For example, first end of the flexible conduit 28 may have a threaded coupling 34 while the opposite end, second end has a friction-fit coupling 36, as illustrated in FIGS. 2 and 3, or vice versa. This flexibility in coupling configuration allows users to select the connection method that best suits their specific needs, whether prioritizing secure attachment, ease of cleaning, or rapid component interchange.

The first and second mouthpieces 24 and 25 are configured to removably seat on their corresponding first and second mouthpiece sockets 14 and 15 of the inner cap 12. The first and second mouthpiece sockets 14 and 15 provide fixture points for mounting the first and second mouthpieces 24 and 25 onto the inner cap 12, securing them in position during use. When installed, the first mouthpiece 24 is configured to seat on the first mouthpiece socket 14, and the second mouthpiece 25 is configured to seat on the second mouthpiece socket 15. Each mouthpiece includes a corresponding first and second guiding openings 31, 33 having an inner conical shape, and each respective mouthpiece socket 14, 15 has a complementary outer conical shape. The mating conical shapes allow the mouthpieces to seat tightly on the sockets to form a secure, fluid-tight connection.

Although as shown in the FIGS. 2 and 3 the first mouthpiece 24 is associated with the first mouthpiece socket 14 and the second mouthpiece 25 is associated with the second mouthpiece socket 15, the mouthpieces are interchangeable and may be seated on either socket depending on user preference and configuration. This fixture arrangement allows the mouthpieces to be readily removed for cleaning, replacement, or reconfiguration while maintaining secure attachment during operation.

Figure 4A:
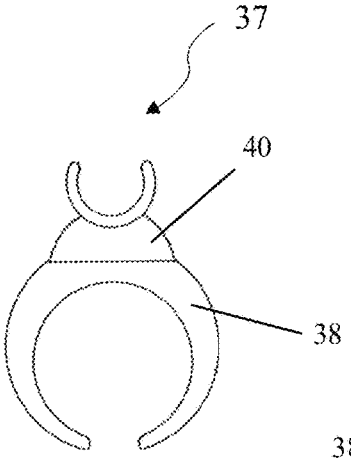
FIG. 4*a* shows a frontal view of a magnetic mouthpiece holder.
Figure 4B:
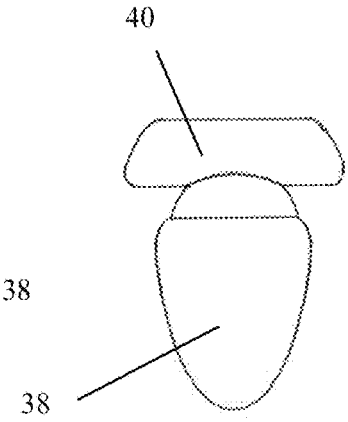
FIG. 4*b* shows a side view of a magnetic mouthpiece holder.
Figure 4C:
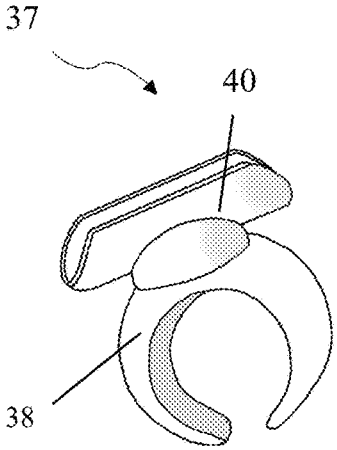
FIG. 4*c* shows a perspective elevated view of a magnetic mouthpiece holder.
Figure 4D:
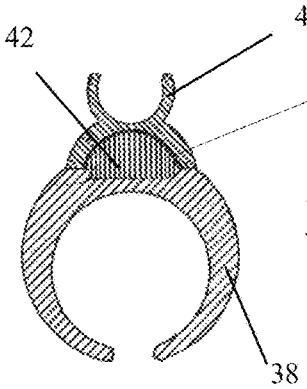
FIG. 4*d* shows a cross-sectional view of a magnetic mouthpiece holder along the line II-II of FIG. 4*e;*
Figure 4E:
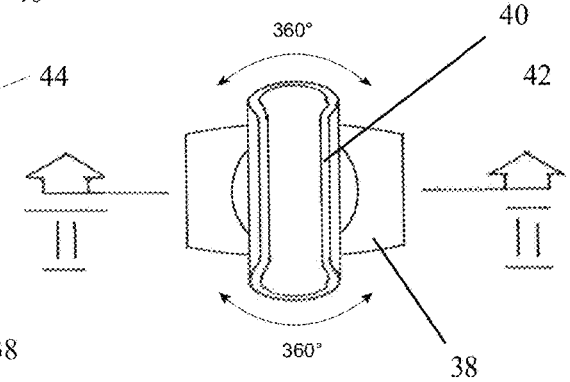
FIG. 4*e* shows top-down view of a magnetic mouthpiece holder.
Figure 4F:
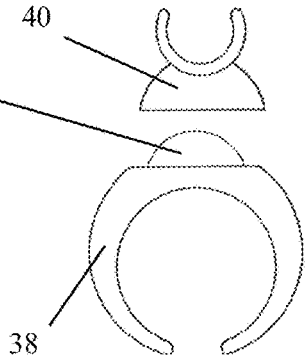
FIG. 4*f* shows a side, exploded view of a magnetic mouthpiece holder.

FIG. 4*a-f* exemplify various views of the magnetic mouthpiece holder 37. FIG. 4*a* shows the mouthpiece receptacle 40 with the ring 38, designed to cradle the first or second mouthpieces 25, 24. The ring 38 includes an opening at a lower portion thereof, allowing the ring 38 to accommodate fingers of varying sizes. The opening and a split-ring or C-shaped configuration permit limited elastic deformation, enabling the ring 38 to expand or contract for a comfortable and secure fit on a user's finger while maintaining sufficient retention force to support the magnetic mouthpiece holder 37 during use. FIG. 4*b* illustrates the magnetic mouthpiece holder 37 in a side view. FIG. 4*c* presents an elevated perspective view of the magnetic mouthpiece holder 37. FIG. 4*d* shows a cross-sectional view taken along line II-II of FIG. 4*e*, illustrating the magnetic attachment components, including the male magnet 42 integrated into the structure of the ring 38, as well as the internal structure of the mouthpiece receptacle 40. FIG. 4*d* further illustrates the interaction between the mouthpiece receptacle 40 and the male magnet 42 to form a releasable magnetic retention system. The mouthpiece receptacle 40 may be formed of metal, or may include an attached layer of female metal element 44, thereby allowing the receptacle 40 to be formed from materials other than metal. FIG. 4*e* illustrates the magnetic mouthpiece holder 37 in a top-down view, revealing a symmetrical design. The mouthpiece receptacle 40 is rotatable relative to the ring 38, including through a full 360-degree range of motion. FIG. 4*f* shows an exploded side view of the magnetic mouthpiece holder 37, illustrating how the mouthpiece receptacle corresponds to the male magnet 42 to create the releasable magnetic retention system.

The female metal element 44 may be a layer of ferromagnetic metal piece or a second magnet with opposite polarity or the mouthpiece receptacle 40 may be made of metal. This magnetic coupling provides sufficient retention force, typically 0.5 to 2 pounds of pull force, to keep the second mouthpiece 25 securely positioned during vehicle motion, walking, or other activities, while allowing easy one-handed separation with a gentle pulling motion when the user wishes to do so.

Figure 5:
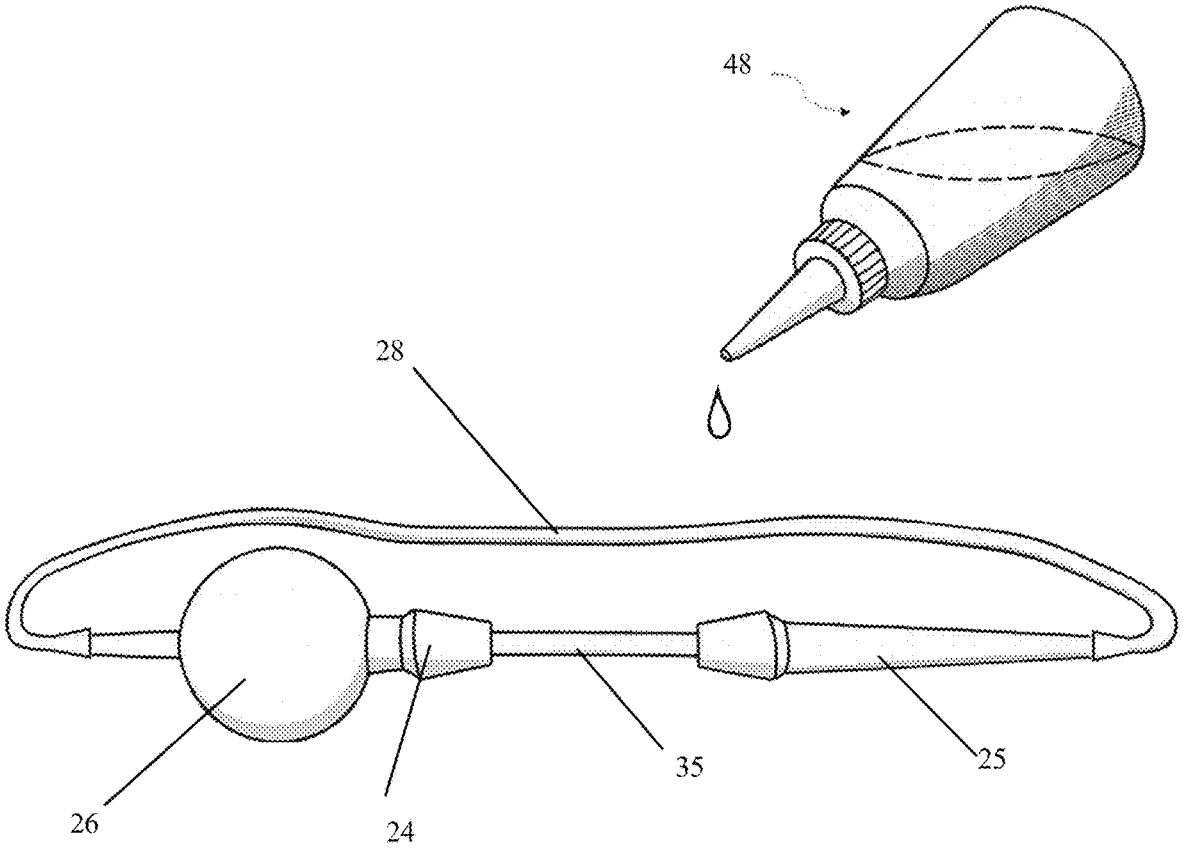
FIG. 5 shows a the closed-system cleaning method with two mouthpieces connected via the flexible conduit.

FIG. 5 exemplifies a closed-system cleaning method in which the flexible conduit 28 connects the first mouthpiece 24 to the second mouthpiece 25 by inserting the second tube 35 into the first and second guiding openings 31 and 33, thereby forming a sealed loop. A sanitizer 48 is introduced, for example from a squeeze bottle, into one of the first or second guiding openings 31 or 33. This closed-loop cleaning configuration allows the sanitizing solution to be distributed throughout the internal surfaces of the flexible conduit 28 and both mouthpieces 24, 25 through agitation, without requiring disassembly of the components.

The sanitizer 48 used in the closed-system cleaning method may be any appropriate cleaning solution, including diluted vinegar solution (typically 1part white vinegar to 3 parts water), hydrogen peroxide solution (3% concentration), commercial sanitizing tablets dissolved in water, or specialized beverage system cleaning solutions. The sanitizer 48 is selected to be effective against bacteria, mold, and biofilm while being safe for food-contact surfaces and compatible with the materials used in the flexible conduit 28 and first and second mouthpieces 24 and 25.

The sealed system is agitated by shaking or manipulating the flexible conduit for 30 seconds to 2 minutes, distributing the sanitizer throughout the internal surfaces.

The system is allowed to rest for 5 to 15 minutes to permit adequate contact time for sanitization. Finally, the system is flushed with clean water by disconnecting one mouthpiece, running water through the flexible conduit, and allowing air-drying with both ends open.

Figure 6:
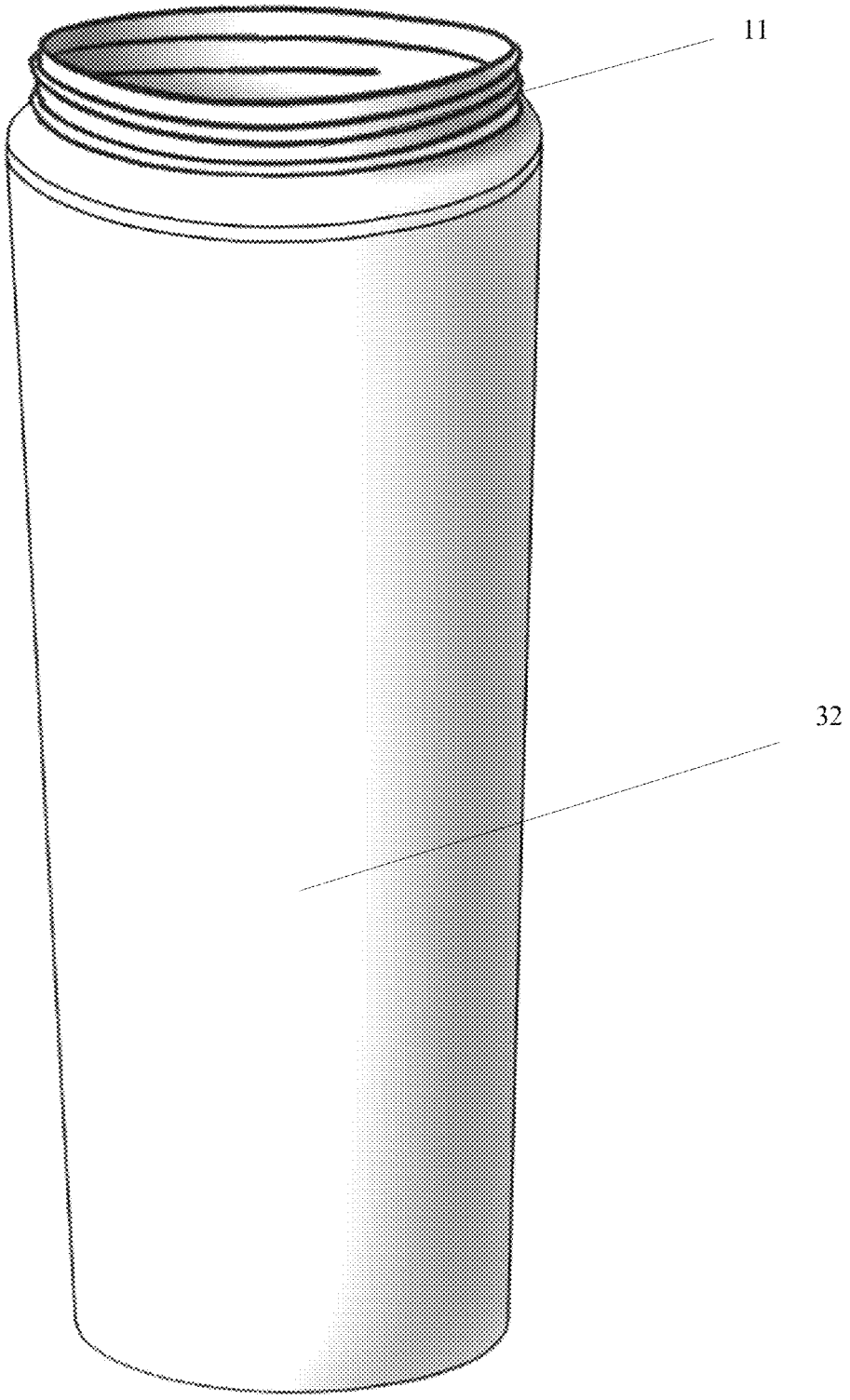
FIG. 6 shows an alternative embodiment of the container designed for compatibility with standard automotive cup holders.

FIG. 6 exemplifies an alternative embodiment showing the car container 32 specifically designed for compatibility with standard automotive cup holders. Car container 32 is an alternative embodiment of container 10. The car container 32 may be configured in various sizes and proportions depending on the specific needs, place of use, and intended application. For vehicular use, this embodiment demonstrates a cylindrical container with dimensions optimized for secure placement in vehicle cup holders, typically having a narrow profile with a diameter between 2.5 and 3.5 inches and featuring a tapered or contoured lower portion for stable retention. Conversely, for desktop or stationary use, the car container 32 may incorporate a wider base diameter, ranging from 4 to 6 inches, to provide enhanced stability and prevent tipping during use. The height-to-width ratio may also be adjusted based on the intended environment-taller, narrower configurations for space-constrained areas such as vehicle consoles, and shorter, wider configurations for office or home settings where stability is prioritized over compactness. The container 10 serves as the primary fluid reservoir and may be constructed of insulated stainless steel or other temperature-retention materials. The container 10 features container threads 11 at its upper opening, allowing secure attachment of the cap. The container 10 may incorporate double-wall vacuum insulation to maintain beverage temperature for extended periods, whether hot or cold. The exterior surface may include anti-slip texturing or coating to facilitate handling during filling operations.

FIG. 7 exemplifies a top-down view of the tumbler 100 without the cap 16, revealing the inner cap 12 with the second mouthpiece socket 15. The flexible conduit 28 extends from the second mouthpiece socket 15. The spherical knob 26 is also shown from the top. This view demonstrates how the components are arranged to maintain a compact profile while allowing the flexible conduit to extend in any direction convenient to the user.

The tumbler 100 is designed to be used during daily commutes, long-distance driving, ride-sharing operations, commercial truck driving, cycling, wheelchair use, office work at computer workstations, manufacturing or assembly line work, medical procedures requiring sustained attention, air traffic control operations, security monitoring, and any other activity where the user's hands and attention are occupied with primary tasks requiring sustained focus.

The materials used in construction of the tumbler 100 are selected for their durability, safety, and compatibility with various beverages. The container 10 may be manufactured from stainless steel (grade 304 or 316), aluminum with food-safe coating, or BPA-free. The inner cap 12, cap 16, the first and second mouthpiece sockets 14 and 15, and spherical knob 26 may be manufactured from food-grade plastics such as polypropylene (PP) or polyethylene (PE), from stainless steel, or from any other material suitable for the food contact application.

The rubber seal 22 is made from silicone, EPDM rubber, or other elastomeric materials that provide effective sealing while being resistant to temperature extremes and compatible with various beverages including water, coffee, tea, juice, and sports drinks.

The portable nature of the tumbler 100, combined with its easy operation and multiple mounting options, ensures that users always have access to hydration without compromising their attention to critical tasks. The hermetic sealing system maintains beverage temperature and prevents contamination during extended use, making the device suitable for daily commuting, professional driving operations, emergency vehicle operations, long-distance travel, or any situation where maintaining focus while staying hydrated is essential for safety and performance.

What is claimed is:

1. A tumbler comprising:

a container having an opening at an upper part thereof;

an inner cap configured to fit within the opening, the inner cap having at least two mouthpiece sockets, a first mouthpiece socket and a second mouthpiece socket;

a cap;

a flexible conduit having a first end and a second end;

at least two mouthpieces, a first mouthpiece and a second mouthpiece;

at least two tubes, a first tube and a second tube; and a magnetic mouthpiece holder incorporating a mouthpiece receptacle and a ring.

2. The tumbler of claim 1, wherein the first tube extends through the first mouthpiece socket and connects to the first mouthpiece through a first guiding opening.

3. The tumbler of claim 2, wherein the flexible conduit at the first end connects to an end opposite to the guiding opening of the first mouthpiece.

4. The tumbler of claim 3, wherein a threads located on the end opposite to the guiding opening of the first mouthpiece engage with a female threads located in the first end of the flexible conduit.

5. The tumbler of claim 3, wherein the flexible conduit at the second end connects to an end opposite to the guiding opening of the second mouthpiece.

6. The tumbler of claim 5, wherein the second end of the flexible conduit is a friction fit coupling.

7. The tumbler of claim 5, wherein the second tube at one end connects to the second mouthpiece through a second guiding opening.

8. The tumbler of claim 7, wherein a ring tip connects to an end of the second tube opposite to the end which connects to the second mouthpiece.

9. The tumbler of claim 7, wherein the second tube is configured to be inserted into the second mouthpiece socket.

10. The tumbler of claim 1, wherein the at least one of the at least two mouthpieces has a spherical knob attached thereto.

11. The tumbler of claim 1, wherein the container has a container threads located on an outer part of the opening and the cap has an inner cap threads configured to engage with the container threads.

12. The tumbler of claim 1, wherein the inner cap has a lip configured to sit on the opening of the container and the cap has a rubber seal positioned at the inner part thereof.

13. The tumbler of claim 1, wherein the cap, at its upper part, includes a lid.

14. The tumbler of claim 1, wherein the ring further comprising a male magnet, and the mouthpiece receptacle is constructed of ferromagnetic metal configured to magnetically couple with the male magnet.

15. The tumbler of claim 1, wherein the ring further comprising a male magnet and the mouthpiece receptacle includes a female metal element configured to magnetically engage with the male magnet.

* * * * *